US006681733B2

(12) United States Patent
Ichimoto et al.

(10) Patent No.: US 6,681,733 B2
(45) Date of Patent: Jan. 27, 2004

(54) VALVE OPENING/CLOSING TIMING CONTROL APPARATUS AND METHOD

(75) Inventors: Kazuhiro Ichimoto, Nisshin (JP); Ikuo Ando, Susono (JP); Yusuke Kamijo, Suntou-gun (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/438,215

(22) Filed: May 15, 2003

(65) Prior Publication Data

US 2003/0221648 A1 Dec. 4, 2003

(30) Foreign Application Priority Data

May 29, 2002 (JP) ..... 2002-156347

(51) Int. Cl.[7] ..... F01L 1/34

(52) U.S. Cl. ..... 123/90.15; 123/90.16; 123/90.17; 74/568 R

(58) Field of Search ..... 123/90.15, 90.16, 123/90.17, 90.31; 74/568 R; 464/1, 2, 160

(56) References Cited

U.S. PATENT DOCUMENTS 6,035,816 A 3/2000 Ogawa et al.
6,330,870 B1 * 12/2001 Inoue et al. ..... 123/90.17
6,450,137 B2 * 9/2002 Ogawa ..... 123/90.17

FOREIGN PATENT DOCUMENTS

JP A 2000-320356 11/2000

* cited by examiner

*Primary Examiner*—Thomas Denion
*Assistant Examiner*—Jaime Corrigan
(74) *Attorney, Agent, or Firm*—Oliff & Berridge PLC

(57) ABSTRACT

A valve opening/closing timing control apparatus and method can be used with a camshaft whose rotation is synchronized with opening/closing timing of an intake valve or an exhaust valve in an internal combustion engine; a relative rotation angle adjustment mechanism which transmits torque of a crankshaft in the internal combustion engine to the camshaft and which adjusts a relative rotation angle between the crankshaft and the camshaft; and a lock mechanism which depends on hydraulic fluid, and which mechanically locks or unlocks the relative rotation angle that is adjusted by the relative rotation angle adjustment mechanism. The apparatus and method determine the duration of a time period from a start of the internal combustion engine until a start of relative rotation angle adjustment, based upon an unlocking force of the hydraulic fluid that is applied to the lock mechanism when the lock mechanism is locked and the internal combustion engine is started.

50 Claims, 14 Drawing Sheets

VALVE OPENING/CLOSING TIMING CONTROL APPARATUS AND METHOD

INCORPORATION BY REFERENCE

The disclosure of Japanese Patent Application No. 2002-156347 filed on May 29, 2002, including the specification, drawings and abstract is incorporated herein by reference in its entirety.

BACKGROUND OF THE INVENTION

1. Field of Invention

The invention relates to a valve opening/closing timing control apparatus and method.

2. Description of Related Art

A conventional valve opening/closing control apparatus is disclosed in Japanese Patent Laid-Open Publication No. 2000-320356. This apparatus includes a camshaft whose rotation is synchronized with opening/closing timing of an intake valve or an exhaust valve in an internal combustion engine, a relative rotation angle adjustment mechanism which transmits torque of a crankshaft in the internal combustion engine to the camshaft and which adjusts a relative rotation angle between the crankshaft and the camshaft, and a lock mechanism which utilizes hydraulic fluid, and which mechanically locks or unlocks the relative rotation angle that is adjusted by the relative rotation angle adjustment mechanism.

In the internal combustion engine in which an intake stroke, a compression stroke, an explosion stroke and an exhaust stroke are repeated, a rotational position of the crankshaft indicates timing of each stroke. Accordingly, valve opening/closing timing in each stroke can be controlled by transmitting the rotational position of the crankshaft to the camshaft. When the relative rotation angle between the crankshaft and the camshaft changes, opening/closing timing of the valve which opens or closes in synchronization with rotation of the camshaft changes. Accordingly, pressure inside a cylinder of the internal combustion engine can be changed to a desired value, and efficient driving can be performed.

In this case, the relative rotation angle is locked by the lock mechanism at the start time of the internal combustion engine. The lock mechanism in the locked state can be unlocked by hydraulic fluid.

However, sometimes at the start time of the internal combustion engine, the lock mechanism in the locked state cannot be unlocked promptly. At such times, when the rotation angle is adjusted, load is placed on the lock mechanism because it is still locked. In cases where the lock mechanism can be promptly unlocked, or in the case where the lock mechanism has been unlocked, if the relative rotation angle is not adjusted for a long time (for example, if adjustment is always delayed by a predetermined amount in order to ensure that the lock mechanism will be in the unlocked state), efficiency and operating performance of the internal combustion engine cannot be enhanced.

SUMMARY OF THE INVENTION

The invention is made in consideration of such a problem. It is one object of the invention to provide a valve opening/closing timing control apparatus and method which is capable of enhancing efficiency and operating performance of an internal combustion engine.

The valve opening/closing timing control apparatus and method according to the invention can be used with a camshaft whose rotation is synchronized with opening/closing timing of an intake valve or an exhaust valve of an internal combustion engine, a relative rotation angle adjustment mechanism which transmits torque of a crankshaft of the internal combustion engine to the camshaft and which adjusts a relative rotation angle between the crankshaft and the camshaft, and a lock mechanism which utilizes hydraulic fluid, and which selectively mechanically locks or unlocks the relative rotation angle that is adjusted by the relative rotation angle adjustment mechanism.

As an exemplary embodiment of the invention, a valve opening/closing timing control apparatus and method operates such that, when the lock mechanism is in the locked state and the internal combustion engine is started, a controller implementing the inventive method determines a duration of a time period from a start of the internal combustion engine until a start of relative rotation angle adjustment by the relative rotation angle adjustment mechanism based on an unlocking force of the hydraulic fluid which is applied to the lock mechanism. As used herein, the term "computation" includes extraction of a value using a map (using a look-up table), as well as other forms of computation, for example, in which equations are solved.

In this control apparatus and method, after the start of the internal combustion engine, when the lock mechanism is difficult to unlock, relative rotation angle adjustment is delayed so as to protect the lock mechanism. Meanwhile, when the lock mechanism can be promptly unlocked, the relative rotation angle is promptly adjusted.

Namely, when the unlocking force of the hydraulic fluid which controls the lock mechanism is small, the lock mechanism cannot be promptly unlocked. Accordingly, the lock mechanism is protected by delaying relative rotation angle adjustment (by extending the duration of the above-mentioned time period). Meanwhile, when the unlocking force of the hydraulic fluid is large, the lock mechanism can be promptly unlocked. Accordingly, relative rotation angle adjustment is promptly performed (the duration of the above-mentioned time period is shortened), and a preferable valve opening/closing timing is realized promptly. As a result, efficiency and operating performance of the internal combustion engine can be enhanced.

In the above-mentioned case, it is assumed that relative rotation angle adjustment relates to unlocking of the lock mechanism, that is, unlocking control is subject to adjustment control to a certain extent. However, even when relative rotation angle adjustment is independent of unlocking of the lock mechanism, the above-mentioned effect can be obtained. More particularly, it is possible to configure a relative rotation angle adjustment mechanism which is capable of completely unlocking the lock mechanism before relative rotation angle adjustment, that is, a relative rotation angle adjustment mechanism which is capable of controlling adjustment and unlocking independently. In this case, since it can be estimated that unlocking of the lock mechanism is incomplete when the unlocking force is small, the lock mechanism can be protected. Also, since it can be estimated that unlocking of the lock mechanism is complete when the unlocking force is large, preferable valve opening/closing timing can be promptly realized.

In this case, the unlocking force signifies a degree of promoting unlocking by the lock mechanism. The unlocking force may be either an instantaneous value or an integrated value. Also, the hydraulic fluid is oil in the case of hydraulic pressure control. However, the hydraulic fluid may be another fluid.

BRIEF DESCRIPTION OF THE DRAWINGS

The above mentioned and other objects, features, advantages, technical and industrial significance of this invention will be better understood by reading the following detailed description of the exemplary embodiments of the invention, when considered in connection with the accompanying drawings, in which.

DETAILED DESCRIPTION OF PREFERRED EMBODIMENTS

In the following description and the accompanying drawings, the invention will be described in more detail in terms of exemplary embodiments.

Hereafter, a valve opening/closing timing control apparatus according to an embodiment will be described.

Figure 1:
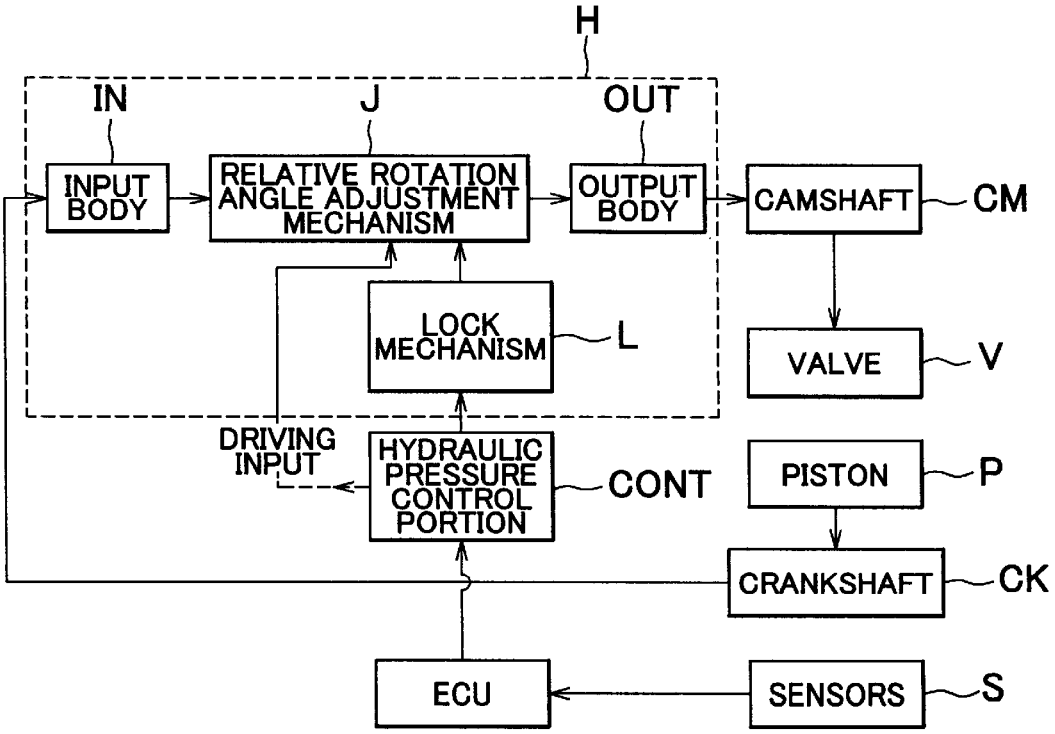
FIG. 1 is a block diagram showing a power system including a valve opening/closing timing control apparatus according to the invention.

FIG. 1 is a block diagram showing a power system including a valve opening/closing timing control apparatus. This power system is mounted on a vehicle, and includes an internal combustion engine for rotating a wheel of the vehicle.

The internal combustion engine includes a piston P which reciprocates inside a cylinder, an intake valve which introduces intake air into the piston P and a combustion space which is formed inside the cylinder, and an exhaust valve which discharges exhaust gas generated in the combustion space. In FIG. 1, these valves are collectively referred to as a valve V.

In the internal combustion engine, an intake stroke, a compression stroke, an explosion stroke and an exhaust stroke are repeated. Reciprocation energy of the piston P is transmitted to a crankshaft CK such that the crankshaft CK rotates. A rotational force of the crankshaft CK is transmitted to one or more wheels such that the vehicle can run using the power system. This description is applied to the case of a reciprocal engine. In the case of a rotary engine, energy can be obtained by rotating a rotor instead of using the reciprocation energy of the piston P.

The rotational position of the crankshaft CK corresponds to a position of the piston P, and indicates each stroke timing in the internal combustion engine. Accordingly, valve opening/closing timing in each stroke can be controlled by transmitting the rotational position of the crankshaft CK to a camshaft CM.

The rotational position of the crankshaft CK is transmitted to the camshaft through a relative rotation angle adjustment device H. The rotational force of the crankshaft CK is also transmitted to the camshaft through the relative rotation angle adjustment device H such that valve opening/closing force is supplied to the camshaft CM at desirable timing.

A plurality of noncircular cams is provided in the camshaft CM. The valve opening/closing force by the noncircular cam is supplied depending on the rotational position of the camshaft CM, and the rotational force of the camshaft CM is obtained from the rotational force of the crankshaft CK.

When the relative rotation angle between the crankshaft CK and the camshaft CM changes, the opening/closing timing of the valve V which opens or closes in synchronization with rotation of the camshaft CM changes. Accordingly, the pressure inside the cylinder can be changed to a desirable value such that efficient driving can be performed.

The relative rotation angle adjustment device H includes an input body IN which is supplied with the rotational force and the rotational position of the crankshaft CK, an output body OUT to which the rotational force and the rotational position of the input body IN are transmitted, and a relative rotation angle adjustment mechanism J which is provided between the input body IN and the output body OUT and adjusts a relative rotation angle (phase) which adjusts a mechanical connection relation between the input body IN and the output body OUT. The rotational operation of the relative rotation angle adjustment mechanism can be controlled by lock mechanism L which depends on hydraulic fluid.

Namely, the hydraulic pressure dependent lock mechanism L can mechanically lock or unlock the relative rotation angle using the pressure of the oil which is introduced thereinto. Another fluid may be used as the oil which is used for controlling the hydraulic pressure. The lock mechanism locks or unlocks the relative rotation angle using such hydraulic fluid.

As mentioned above, the internal combustion engine is provided with the valve opening/closing timing control apparatus including the camshaft CM whose rotation is synchronized with opening/closing timing of an intake valve or an exhaust valve in an internal combustion engine, the relative rotation angle adjustment mechanism J which transmits the rotational force of the crankshaft CK to the camshaft CM and adjusts the relative rotation angle between the crankshaft CK and the camshaft CM, and the lock mechanism L which depends on hydraulic fluid, and which mechanically locks or unlocks the relative rotation angle that is adjusted by the relative rotation angle adjustment mechanism J.

The oil which is supplied to the hydraulic pressure dependent lock mechanism L is supplied from a hydraulic pressure control portion (a hydraulic pressure control portion) CONT. Therefore, the relative rotation angle can be locked or unlocked by controlling the supply of the oil from the hydraulic pressure control portion CONT to the hydraulic pressure dependent lock mechanism L.

Meanwhile, the relative rotation angle adjustment mechanism J can change the relative rotation angle depending on driving input. This driving input may be, for example, energy which is necessary to change the relative rotation angle when the relative rotation angle adjustment mechanism J is a passive mechanism. Meanwhile, when the relative rotation angle adjustment mechanism is an active mechanism which has driving ability, driving input may be a control signal. In the embodiment, the relative rotation angle adjustment mechanism J is a passive mechanism, and driving input is energy.

When driving input is energy for controlling hydraulic pressure in the mechanism J, it is necessary to supply the oil to the relative rotation angle adjustment mechanism J from one or more portions. In the embodiment, the relative rotation angle adjusted by the relative rotation angle adjustment mechanism J is changed using the oil which is supplied from the hydraulic pressure control portion CONT as driving input. In this case, the hydraulic pressure control portion CONT may be a pump which supplies the oil. The driving energy of the pump may be kinetic energy which is generated by the internal combustion engine, or electric energy which is then converted to kinetic energy.

The structure of the relative rotation angle adjustment device H (and its components J, L, IN, OUT), the hydraulic pressure control portion CONT, and elements CM, CK, V and P can be known, conventional structures.

The hydraulic control portion CONT is controlled by an electronic control unit (control apparatus) ECU. The electronic control unit ECU performs a computation on the optimum valve opening/closing timing based on the input from various sensors S such as an intake pressure sensor, a rotational speed sensor, an engine speed sensor, a crank angle sensor, a cam angle sensor, a water temperature sensor, and an ignition switch, and provides an instruction to the hydraulic pressure control portion CONT such that the valve V opens or closes at the computed timing. In an operation mode of a certain type, the hydraulic pressure control portion CONT provides the relative rotation angle adjustment mechanism J with driving input which realizes such valve opening/closing timing.

In the embodiment, the hydraulic pressure control portion CONT controls the lock mechanism L using the hydraulic pressure, in addition to adjusting the relative rotation angle.

The electronic control unit ECU includes computation means, such as a processor (CPU), for performing a computation on a time (T) from the start of the internal combustion engine until the start of relative rotation angle adjustment by the relative rotation angle adjustment mechanism J according to an unlocking force (Q) of the hydraulic fluid that is applied to the lock mechanism L when the lock mechanism L is in the locked state and the internal combustion engine is started. Note that the lock mechanism L, in principle, is in the locked state before the start of the internal combustion engine, and the ignition switch functions as a sensor S for confirming whether the internal combustion engine has been started.

Also, the term "computation" includes extraction of values using a map (i.e., using a look-up table).

After the start of the internal combustion engine, the electronic control unit ECU protects the lock mechanism L by delaying the relative rotation angle adjustment when the lock mechanism L is difficult to unlock. Meanwhile, when the lock mechanism L can be unlocked promptly, the relative rotation angle is adjusted promptly. Namely, the electronic control unit ECU determines the time (T) until the hydraulic pressure dependent lock mechanism L is unlocked as follows.

When the unlocking force (Q) of the hydraulic fluid which controls the lock mechanism L is small, the lock mechanism L cannot be promptly unlocked. Accordingly, the lock mechanism L is protected by delaying the relative rotation angle adjustment (by extending the time (T) which is computed by the computation means).

When the unlocking force (Q) of the hydraulic fluid is large, the lock mechanism L can be unlocked promptly. Accordingly, efficiency and the operating performance of the internal combustion engine are enhanced by performing relative rotation angle adjustment promptly (by shortening the time (T) which is computed by the computation means), and by realizing the preferable valve timing promptly.

In the above-mentioned control, the hydraulic pressure control portion CONT controls the lock mechanism L and the relative rotation angle adjustment mechanism J, simultaneously. More specifically, both the lock mechanism L and the relative rotation angle adjustment mechanism J use the hydraulic pressure control portion CONT as the common control source. Therefore, the relative rotational angle adjustment is related to unlocking of the lock mechanism, and unlocking control is controlled by relative rotation angle adjustment control.

Such an operation is related to configurations of the hydraulic fluid inflow routes of the relative rotational angle adjustment mechanism J and the hydraulic pressure dependent lock mechanism L. Accordingly, when there is such a relation between the operations, it is particularly preferable to perform relative rotation angle adjustment after confirming or estimating that the unlocking has been completed, in terms of the protection of the lock mechanism L.

Even when relative rotation angle adjustment is independent of unlocking of the lock mechanism L, the above-mentioned effect can be obtained. More specifically, it is possible to configure a relative rotation angle adjustment device which is capable of completely unlocking the lock mechanism L before relative rotation angle adjustment by the relative rotation angle adjustment mechanism J, that is, a relative rotation angle adjustment device H which is capable of controlling adjustment and unlocking independently. For example, driving input which controls the relative rotation angle adjustment mechanism J and driving input (hydraulic fluid) to the hydraulic pressure dependent lock mechanism L would be independent.

Even in this case, when the unlocking force (Q) is small, it can be estimated that unlocking of the lock mechanism L is incomplete. Accordingly, the lock mechanism L can be protected. Meanwhile, when the unlocking force (Q) is large, it can be estimated that unlocking of the lock mechanism L has been completed. Accordingly, the preferable valve opening/closing timing can be realized promptly.

In this case, the unlocking force (Q) indicates a degree of promoting unlocking of the lock mechanism L. The unlocking force (Q) may be either an instantaneous value or an integrated value. The unlocking force (Q) is indicated as a certain value in the electronic control unit ECU.

Various forms of the lock mechanism L are conceivable. However, for convenience in explanation, the following is indicated as the lock mechanism.

Figure 2:
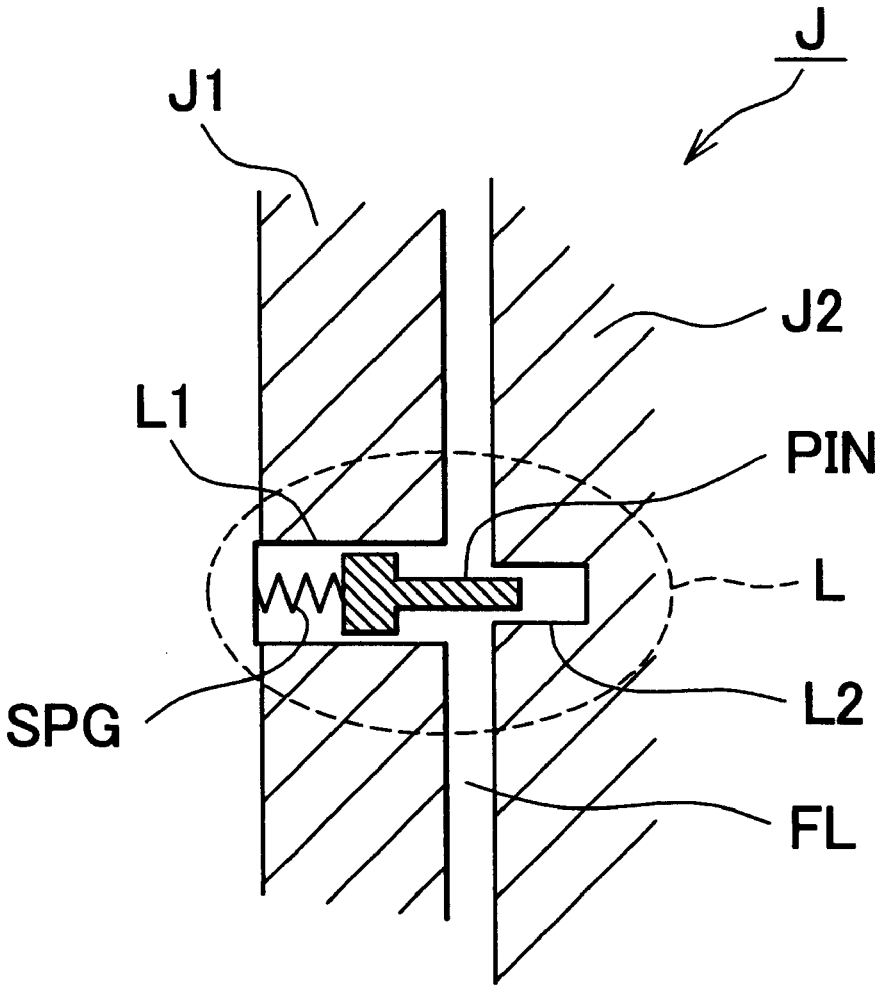
FIG. 2 is a partial sectional view showing a relative rotation angle adjustment mechanism J in which a lock mechanism L is provided.

FIG. 2 is a partial sectional view showing the relative rotation angle adjustment mechanism J in which the lock mechanism L is provided. The relative rotation angle adjustment mechanism J includes a first member J1 and a second member J2 which are relatively rotatable. The first member J1 and the second member J2 are mechanically connected to the input body IN and the output body OUT, respectively, which are shown in FIG. 1. The peripheral shapes of the first member J1 and the second member J2 are circular, and a rotational axis is positioned at the center.

The lock mechanism L includes a first hole portion L1 which is provided in the first member J 1, a second hole portion L2 which is provided in the second member J2, a lock portion (pin) PIN which is provided inside the first hole portion L1, and elastic means (e.g., a spring) SPG that urges the lock member PIN toward the second member J2.

In the case where the first hole member L1 faces the second hole member L2, when the elastic means SPG urges the lock member PIN toward the second hole portion L2, a tip portion of the lock member PIN is engaged with the second hole portion L2. As a result, relative movement between the first member J 1 and the second member J2 is prohibited. This state corresponds to a state in which the relative rotation angle is locked. In this case, the hydraulic fluid FL is not supplied from the hydraulic pressure control portion CONT shown in FIG. 1.

When the hydraulic fluid FL is supplied from the hydraulic pressure control portion CONT to a clearance between the first member J1 and the second member J2, the force which is provided by the pressure of the hydraulic fluid FL to the lock member PIN toward the first member J1 is larger than the force which is provided by the elastic means SPG to the lock member PIN toward the second member J2. As a result, the lock member PIN moves away from the second member J2, and the lock member PIN is removed from the second hole portion L2. This state corresponds to a state in which the relative rotation angle is unlocked.

Next, the unlocking force (Q) will be described in detail. As mentioned above, the unlocking force (Q) indicates a degree of promoting unlocking by the lock mechanism L. In a configuration of the lock mechanism L, the unlocking force (Q) becomes; (I) larger as the pressure of the hydraulic fluid FL becomes higher; (II) larger as the viscosity of the hydraulic fluid becomes lower; and (III) becomes larger as the amount of the hydraulic fluid FL which remains in the lock mechanism becomes larger. More specifically, as the pressure of the hydraulic fluid FL becomes higher, the lock member PIN is removed more promptly. As the viscosity of the hydraulic fluid FL becomes lower, the pressure of the hydraulic fluid FL increases more promptly. Also, as the amount of the hydraulic fluid FL which remains in a clearance between the first member J1 and the second member J2 become larger, the pressure of the hydraulic fluid FL increases more promptly.

Hereafter, the pressure of the hydraulic fluid FL which determines the unlocking force (Q) will be described. As mentioned above, the unlocking force (Q) can be obtained based on the pressure of the hydraulic fluid FL. As the most simple indication of the unlocking force (Q), the pressure of the hydraulic fluid FL itself may be employed. Since the lock mechanism L depends on the hydraulic fluid FL, when the pressure of the hydraulic fluid FL is high, the unlocking force (Q) is large. Meanwhile, when the pressure of the hydraulic fluid FL is low, the unlocking force (Q) is small.

Figure 3:
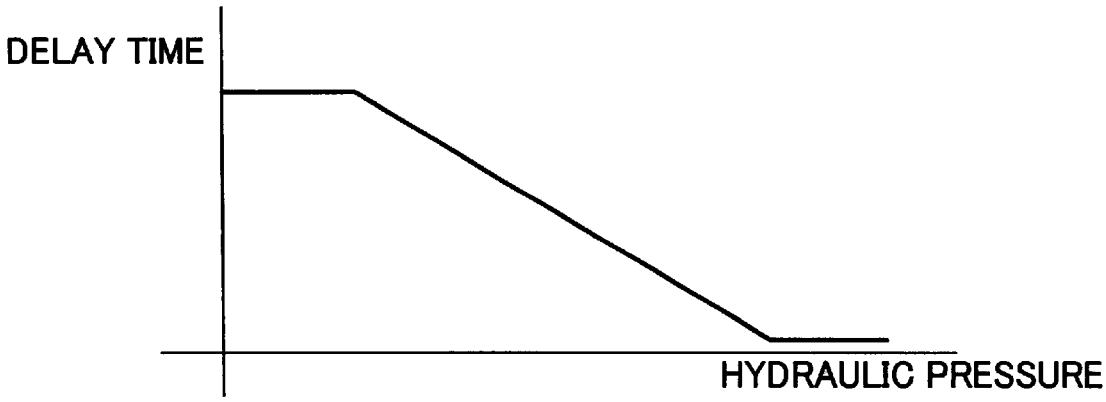
FIG. 3 is a graph showing a relation between a hydraulic pressure and a delay time when oil is used as a hydraulic fluid.

FIG. 3 a graph showing a relation between the hydraulic pressure and the delay time (T) when oil is used as the hydraulic fluid FL. As the unlocking force (Q) becomes larger, the delay time (T) becomes shorter. Accordingly, as the pressure of the hydraulic fluid FL becomes higher, the delay time (T) becomes shorter. In the embodiment, when the hydraulic pressure is equal to or lower than a lower limit, or is equal to or higher than an upper limit, the delay time (T) is maintained to be constant. The constant value is set to be high when the hydraulic pressure is equal to or lower than the lower limit, and is set to be low when the hydraulic pressure is equal to or higher than the upper limit.

The pressure of the hydraulic fluid FL can be obtained by various methods. When the valve opening/closing timing control apparatus includes a hydraulic pressure detection sensor as the sensor S which detects the pressure of the hydraulic fluid FL, an accurate pressure of the hydraulic fluid FL can be detected directly.

When the valve opening /closing timing control apparatus includes estimation means for estimating the pressure of the hydraulic fluid FL based on predetermined input information which is provided from various sensors S, the pressure of the hydraulic fluid FL can be detected indirectly. The estimation means can be realized by the electronic control unit ECU. In this case, the hydraulic pressure detection sensor is not necessary, which makes the configuration of the apparatus more simple. Note that this does not exclude a case in which the valve opening/closing timing control apparatus includes the hydraulic pressure detection sensor which directly detects the hydraulic pressure.

Various estimation methods using estimation means implemented as a program performed in the electronic control unit ECU are possible.

The estimation means estimates the pressure of the hydraulic fluid FL using the temperature of the hydraulic fluid FL as input information from the sensor S. The temperature of the hydraulic fluid FL is related to the pressure of the hydraulic fluid FL. More specifically, when the temperature of the hydraulic fluid FL is high, the pressure of the hydraulic fluid FL is high. Meanwhile, when the temperature of the hydraulic fluid FL is low, the pressure of the hydraulic fluid FL is low. Accordingly, the pressure of the hydraulic fluid FL can be estimated based on the temperature of the hydraulic fluid FL.

Also, the temperature of the hydraulic fluid FL indirectly indicates the pressure of the hydraulic fluid FL. Accordingly, the unlocking force (Q) may be obtained based on the temperature of the hydraulic fluid.

Figure 4:
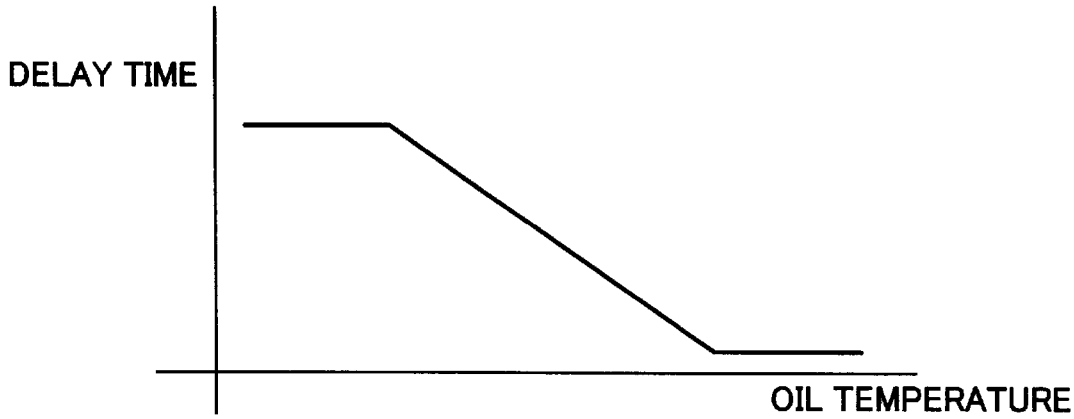
FIG. 4 is a graph showing a relation between an oil temperature and a delay time when oil is used as the hydraulic fluid.

FIG. 4 is a graph showing a relation between the oil temperature and the delay time (T) when oil is used as the hydraulic fluid FL. As the unlocking force (Q) becomes larger, the delay time (T) becomes shorter. Accordingly, as the temperature of the hydraulic fluid FL becomes higher, the delay time (T) becomes shorter. In the embodiment, when the oil temperature is equal to or lower than a lower limit, or is equal to or higher than an upper limit, the delay time (T) is maintained to be constant. When the oil temperature is equal to or lower than the lower limit, this constant value is set to be high. Meanwhile, when the oil temperature is equal to or higher than the upper limit, the constant value is set to be low.

Various methods for detecting the temperature of the hydraulic fluid FL are possible.

As a method for detecting the temperature directly, the estimation means can include a temperature sensor which detects the temperature of the hydraulic fluid FL. The sensor S is a temperature sensor. In this case, an accurate temperature (TEMP 1) of the hydraulic fluid FL can be detected.

Figure 5:
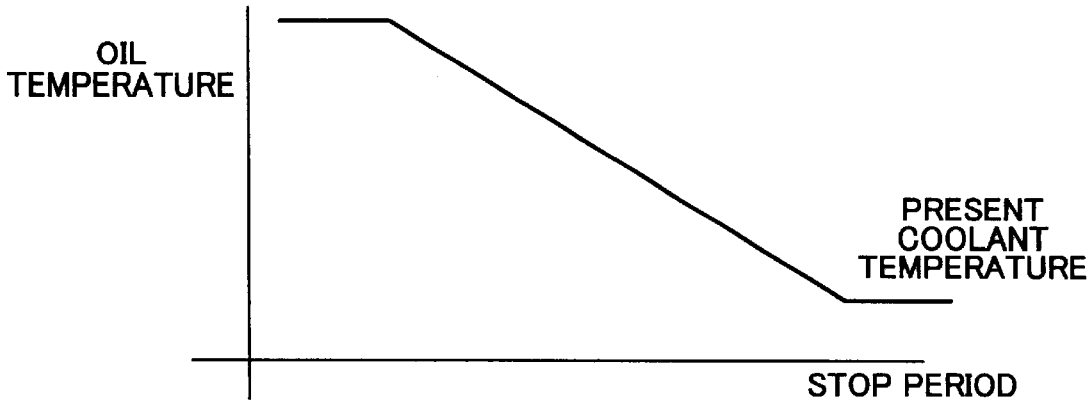
FIG. 5 is a graph showing a relation between a stop period of an internal combustion engine (a stop period of a vehicle) and an oil temperature when oil is used as the hydraulic fluid.

FIG. 5 is a graph showing a relation between a stop period of the internal combustion engine (a stop period of the vehicle) and the oil temperature when oil is used as the hydraulic fluid FL. As the stop period of the vehicle becomes longer, the oil temperature tends to be lower.

Accordingly, the estimation means can estimate the temperature of the hydraulic fluid FL based on the stop period of the internal combustion engine. The stop period of the internal combustion engine can be obtained by using as the sensor S, an ignition switch, and by counting the period from when the switch is turned off using a timer.

In the internal combustion engine, when the power source in which combustion is performed is operating, heat is generated. Accordingly, there is a tendency that the temperature of the hydraulic fluid FL increases during the operating period of the internal combustion engine, and the temperature of the hydraulic fluid FL decreases during the stop period of the internal combustion engine. More particularly, when the stop period of the internal combustion engine is long, the temperature of the hydraulic fluid FL tends to decrease. Meanwhile, when stop period of the internal combustion engine is short, the temperature of the hydraulic fluid FL remains high.

Accordingly, when the stop period of the internal combustion engine is determined, a first estimated temperature (TEMP 2) of the hydraulic fluid FL can be estimated. In this case, the temperature sensor is not necessary, which makes the configuration of the apparatus more simple. The temperature sensor which directly detects the temperature may be included if desired.

Also, when the internal combustion engine is sufficiently cooled, the temperature of the hydraulic fluid FL coincides with the temperature of the cooling medium (temp 1), and an initial value of the temperature of the hydraulic fluid FL can be supplied.

The temperature of the hydraulic fluid FL can be estimated based on another information in addition to the stop period of the internal combustion engine. The estimation means estimates the temperature of the hydraulic fluid FL based on the operating period and or the load of the internal combustion engine after the start thereof in addition to the stop period of the internal combustion engine.

The operating period can be detected by using the ignition switch as the sensor S, and by counting the period from when the switch is turned on using the timer.

The load of the internal combustion engine can be obtained by using an engine speed sensor, a vehicle speed sensor and an accelerator opening sensor as the sensor S, and by previously storing a load state and these detected values in memory.

Figure 6:
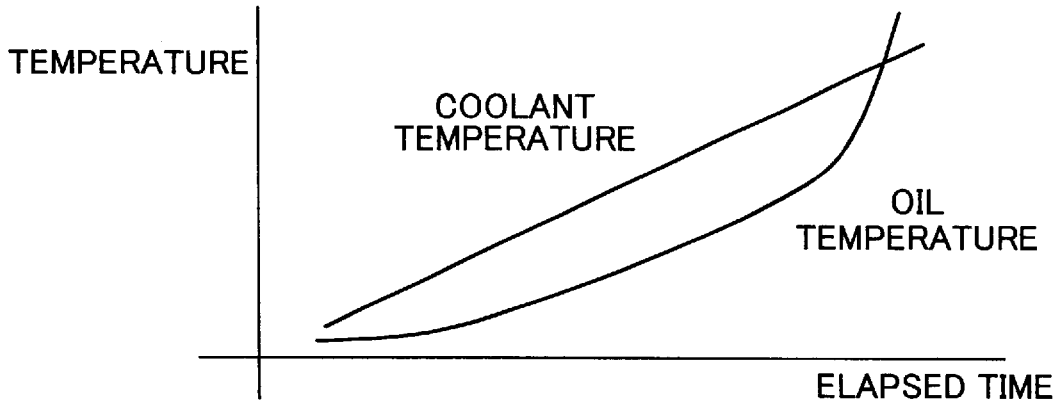
FIG. 6 is a graph showing a relation between an elapsed time since the start of the internal combustion engine, and an oil temperature and a water temperature when oil is used as the hydraulic fluid and water is used as a cooling medium.

FIG. 6 is a graph showing a relation between an elapsed time since the start of the internal combustion engine, and the oil temperature and the water temperature when oil is used as the hydraulic fluid FL and water is used as the cooling medium.

Figure 7:
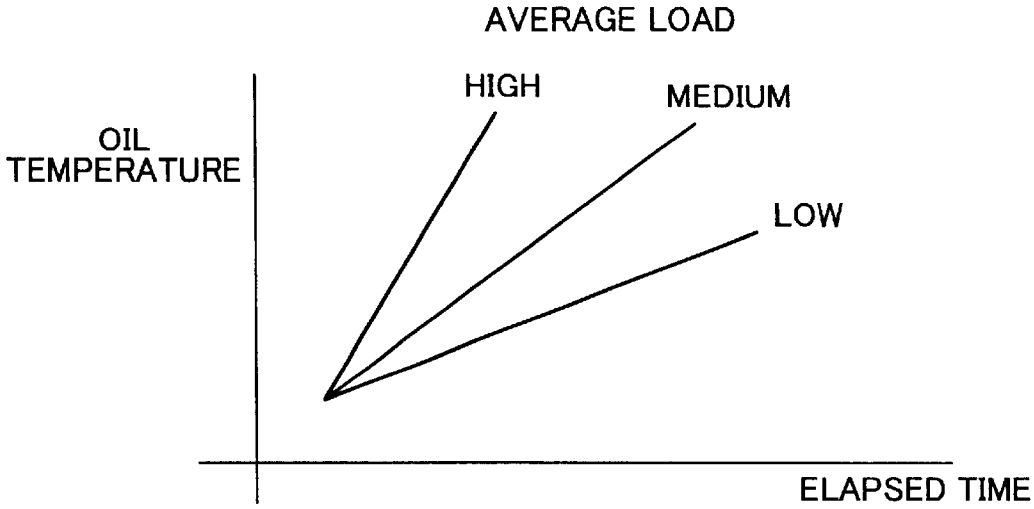
FIG. 7 is a graph showing a relation between an elapsed time since the start of the internal combustion engine and an oil temperature when oil is used as the hydraulic fluid.

FIG. 7 is a graph showing a relation between an elapsed time since the start of the internal combustion engine and the oil temperature when oil is used as the hydraulic fluid FL. Note that an average load is indicated in this diagram.

There is a tendency that as the operating period of the internal combustion (elapsed time) becomes longer, and as the load becomes higher, the temperature of the hydraulic fluid FL increases. Accordingly, a more accurate second estimated temperature (TEMP 2¢) can be estimated by correcting the temperature (TEMP 2) which is estimated based on the stop period of the internal combustion engine by the operating period and /or the load of the internal combustion engine.

The estimated temperatures (TEMP 2, TEMP 2¢) may be used for estimating the pressure of the hydraulic fluid FL. However, in order to obtain a more accurate temperature, the estimated temperature can be corrected based on a value which is closely related to the present temperature of the hydraulic fluid FL.

The estimation means can correct the estimated temperatures (TEMP 2, TEMP 2¢) of the hydraulic fluid FL based on the temperature (temp 1) of the cooling medium which cools the internal combustion engine.

As shown in FIG. 6, the temperature of the cooling medium is a value in which the present temperature of the internal combustion engine is reflected. Accordingly, by using the temperature (temp 1) of the cooling medium, the estimated temperatures (TEMP 2, TEMP 2¢) can be corrected so as to obtain a third estimated temperature (TEMP 2¢¢). The temperature of the cooling medium can be detected by the cooling medium temperature sensor as the sensor S. The cooling medium temperature sensor is a water temperature sensor when the cooling medium is water.

For example, when a relation among the temperature of the hydraulic fluid FL which is directly obtained, the estimated temperature (TEMP 2 or TEMP 2¢) of the hydraulic fluid FL, and the temperature (temp 1) of the cooling medium is previously stored based on measured data, it is possible to directly estimate the temperature of the hydraulic fluid FL based on the estimated temperature (TEMP 2 or TEMP 2¢) of the hydraulic fluid FL, and the temperature (temp 1) of the cooling medium. Namely it is possible to correct the temperature (TEMP 2 or TEMP 2¢) which is estimated based on the stop period, and the operating period and/or the load of the internal combustion engine.

As can be seen from FIG. 6, the temperature of the hydraulic fluid FL can be estimated directly based on the temperature of the cooling medium since the temperature of the cooling medium is correlated to the temperature of the hydraulic fluid FL. Therefore, the estimation means estimates the temperature of the hydraulic fluid FL based on the temperature (temp 1) of the cooling medium which cools the internal combustion engine. The temperature of the hydraulic fluid FL depends on the temperature of the cooling medium. More specifically, when the temperature of the cooling medium is high, the temperature of the hydraulic fluid FL tends to be high. Meanwhile, when the temperature of the cooling medium is low, the temperature of the hydraulic fluid FL tends to be low. Accordingly, a fourth estimated temperature (TEMP 3) of the hydraulic fluid FL can be estimated based on the temperature of the cooling medium. As a matter of course, this estimated temperature can be corrected.

As another method for estimating the pressure of the hydraulic fluid FL, a method in which the temperature of the cooling medium is not used is possible.

Figure 8:
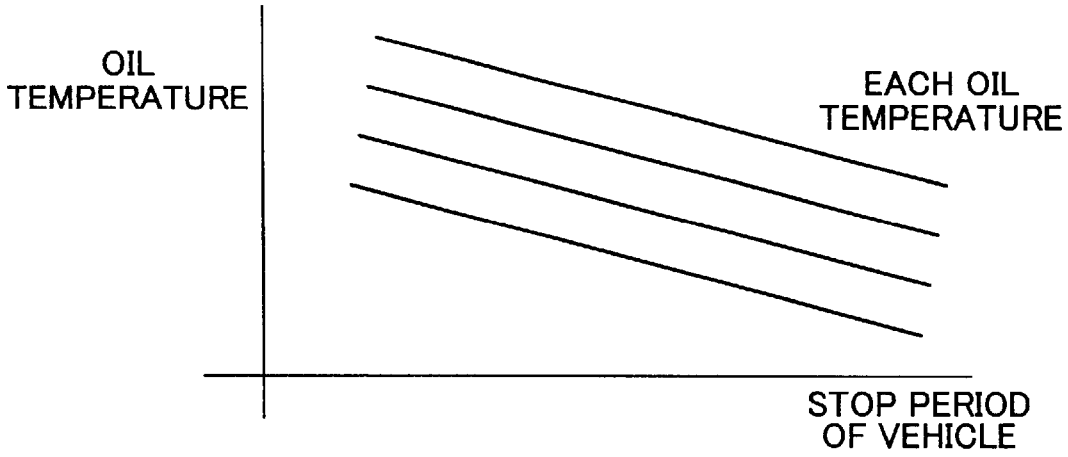
FIG. 8 is a graph showing a relation between a stop period of the internal combustion engine (a stop period of the vehicle) and a hydraulic pressure when oil is used as the hydraulic fluid.

FIG. 8 is a graph showing a relation between the stop period of the internal combustion engine (the stop period of the vehicle) and the hydraulic pressure when oil is used as the hydraulic fluid FL. When the hydraulic pressure decreases as the stop period of the vehicle becomes longer, the estimation means can estimate the hydraulic pressure using the stop period of the internal combustion engine before the start of the internal combustion engine as input information. The method for obtaining this stop period is as mentioned above.

Namely, the pressure of the hydraulic fluid FL depends on the stop period of the internal combustion engine before the start of the internal combustion engine. More specifically, the pressure of the hydraulic fluid FL tends to decrease as the stop period of the internal combustion engine becomes longer. Accordingly, the pressure of the hydraulic fluid FL can be estimated without using the temperature of the cooling medium. The temperature of the cooling medium may be used as desired, and correction may be performed. As the temperature of the hydraulic fluid FL becomes lower, the pressure of the hydraulic fluid FL becomes lower. Accordingly, the estimated pressure can be corrected using the temperature of the hydraulic fluid, in the embodiment, using the oil temperature.

Because the stop period of the internal combustion engine indirectly indicates the pressure of the hydraulic fluid, the unlocking force (Q) may be obtained based on the stop period of the internal combustion engine.

Figure 9:
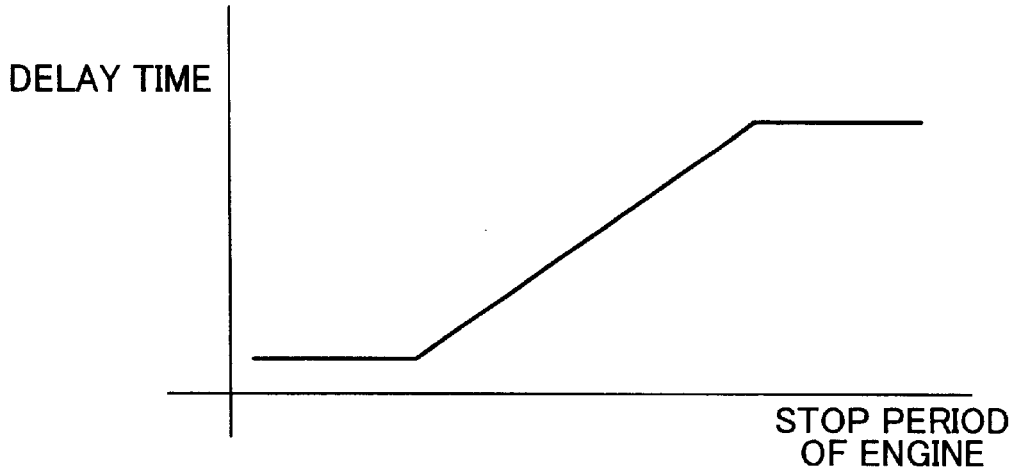
FIG. 9 is a graph showing a relation between a stop period of the internal combustion engine (a stop period of the vehicle) and a delay time.

FIG. 9 is a graph showing a relation between the stop period of the internal combustion engine (the stop period of the vehicle) and the delay time (T). As the unlocking force (Q) becomes larger, the delay time (T) becomes shorter. Accordingly, as the temperature of the hydraulic fluid FL becomes higher, and as the stop period of the vehicle becomes shorter, the delay time (T) becomes shorter. In the embodiment, when the stop period of the vehicle is equal to or shorter than a lower limit, or is equal to or higher than an upper limit, the delay time (T) is maintained to be constant. The constant value is set to be low when the stop period of the vehicle is equal to or shorter than the lower limit, and is set to be high when the stop period of the vehicle is equal to or longer than the upper limit.

Figure 10:
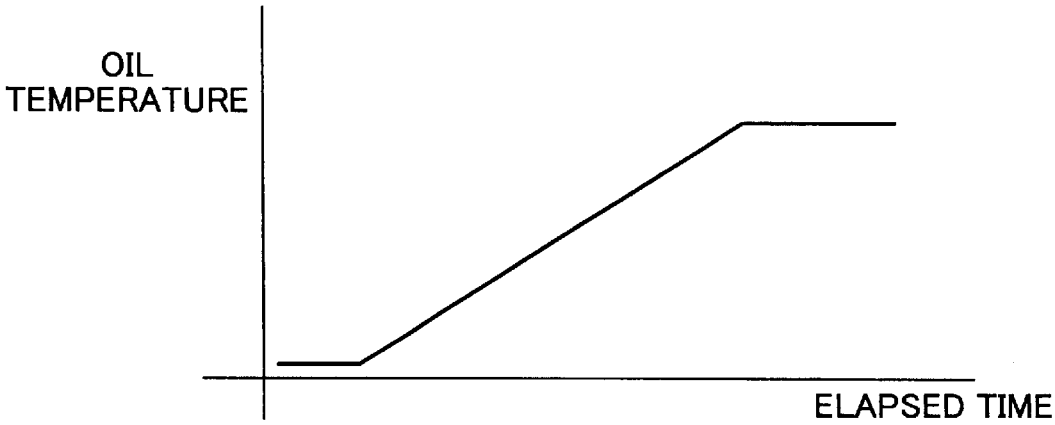
FIG. 10 is a graph showing a relation between an elapsed time since the start of the internal combustion engine and a hydraulic pressure when oil is used as the hydraulic fluid.

FIG. 10 is a graph showing a relation between the elapsed time since the start of the internal combustion engine and the hydraulic pressure when oil is used as the hydraulic fluid FL. The hydraulic pressure increases with time. Accordingly, when the elapsed time exceeds a given threshold value, it can be estimated that the hydraulic pressure has reached the predetermined value. Accordingly, the computation means can perform a computation on the unlocking force (Q) which is obtained based on this hydraulic pressure. As the elapsed time becomes longer, the hydraulic pressure becomes higher. The fact that the elapsed time exceeds the threshold value signifies that the hydraulic pressure exceeds the threshold value. Accordingly, the pressure can be indirectly measured based on the elapsed time.

As the unlocking force (Q) becomes larger, the delay time (T) becomes shorter. Accordingly, as the pressure of the hydraulic fluid FL becomes higher, the delay time (T) becomes shorter. In the embodiment, when the hydraulic pressure is equal to or lower than a lower limit, or is equal to or higher than an upper limit, the delay time is constant. The constant value is set to be low when the hydraulic pressure is equal to or lower than the lower limit, and is set to be high when the hydraulic pressure is equal to or higher than the upper limit.

Since the load of the internal combustion engine is also correlated to the hydraulic pressure, computation can be performed on the unlocking force in the same manner.

Accordingly, the estimation means estimates the pressure of the hydraulic fluid FL using the operating period and/or the load of the internal combustion engine as input information. The method for obtaining the operating period and the load is as mentioned above. The temperature of the cooling medium may be used as desired, and correction may be performed.

The estimation means also may estimate the pressure of the hydraulic fluid FL using, as input information, the temperature (temp 1) of the cooling medium which cools the internal combustion engine. Since the temperature of the cooling medium affects the pressure of the hydraulic fluid FL, the pressure of the hydraulic fluid FL can be estimated based only on the temperature of the cooling medium. Note that correction can be performed based on another information in this case as well.

Namely, since the temperature of the cooling medium indirectly indicates the pressure of the hydraulic fluid FL, the unlocking force (Q) can be obtained based on the temperature of the cooling medium which cools the internal combustion engine.

Figure 11:
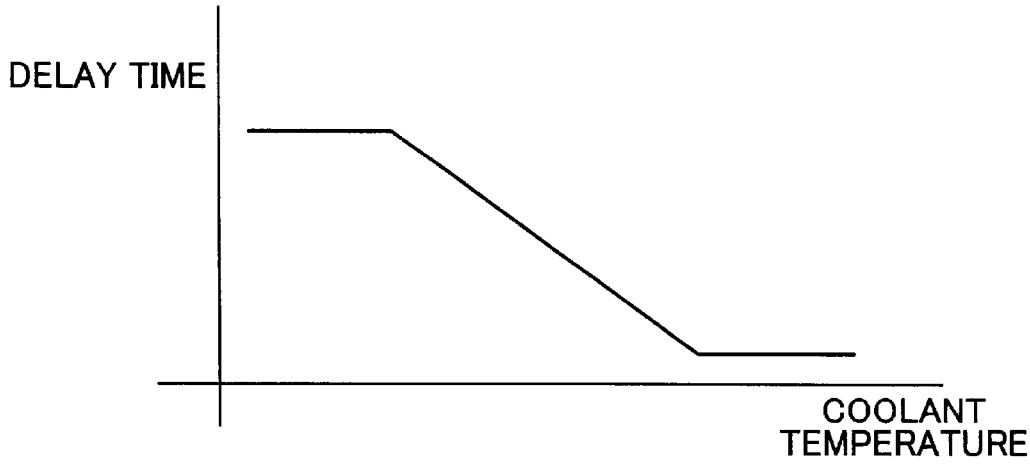
FIG. 11 is a graph showing a relation between a water temperature and a delay time when water is used as the cooling medium.

FIG. 11 is a graph showing a relation between the water temperature and the delay time (T) when water is used as the cooling medium. As the unlocking force (Q) becomes larger, the delay time (T) may be shorter. Accordingly, as the temperature of the cooling medium becomes higher, the delay time (T) is set to be shorter. In the embodiment, when the water temperature is equal to or lower than a lower limit, or is equal to or higher than an upper limit, the delay time (T) is set to be constant. The constant value is set to be high when the water temperature is equal to or lower than the lower limit, and is set to be low when the water temperature is equal to or higher than the upper limit.

The unlocking force (Q) depends on how promptly the pressure of the hydraulic fluid FL increases. When the viscosity of the hydraulic fluid FL is high, it takes a long time until the hydraulic fluid FL is applied to the lock mechanism L. Meanwhile, when the viscosity of the hydraulic fluid is low, the hydraulic fluid FL is applied to the lock mechanism L promptly.

As the viscosity of the hydraulic fluid FL becomes higher, the time (T) until unlocking should be made longer so as to protect the lock mechanism L. Meanwhile, as the viscosity of the hydraulic fluid FL becomes lower, the time (T) until unlocking can be made shorter so as to perform relative rotation angle adjustment promptly. As mentioned above, the unlocking force (Q) becomes smaller as the viscosity of the hydraulic fluid FL becomes higher. However, the effect of the viscosity is small compared with that of the pressure of the hydraulic fluid FL. Accordingly, in the embodiment, viscosity is taken into consideration as supplemental information on the assumption that the pressure is detected.

The computation means performs a computation on the unlocking force (Q) based on the viscosity of the hydraulic fluid FL in addition to the pressure of the hydraulic fluid FL. As the viscosity becomes higher, the unlocking force (Q) becomes smaller. Accordingly, the unlocking force (Q) can be obtained, for example, by dividing the pressure of the hydraulic fluid FL by the viscosity or subtracting the viscosity from the pressure of the hydraulic fluid FL. The computation means may obtain the unlocking force (Q) based on the pressure and the viscosity by using a map in which the unlocking force (Q) is defined according to the pressure and the viscosity of the hydraulic fluid FL.

Figure 12:
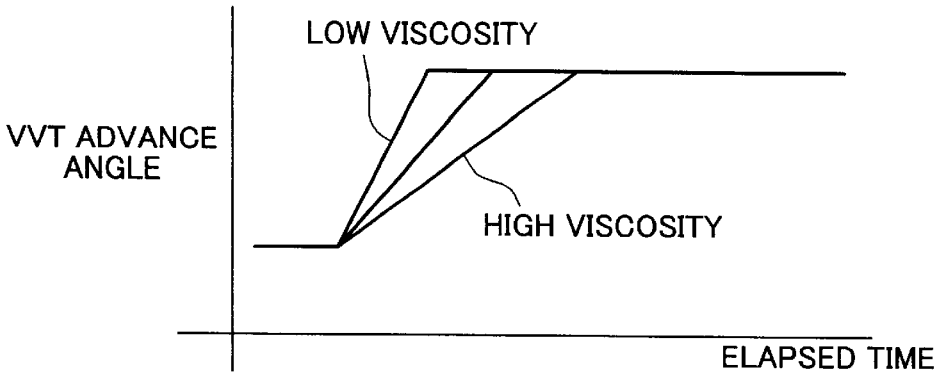
FIG. 12 is a graph showing a relation between an elapsed time since the start of the relative rotation angle adjustment and a relative rotation angle when relative rotation angle adjustment is started.

FIG. 12 is a graph showing a relation between the elapsed time since the start of relative rotation angle adjustment and the relative rotation angle (change to the advance angle side: VVT (variable valve timing control) advance angle value) when relative rotation angle adjustment is started. An upper limit and a lower limit are set on the relative rotation angle.

The viscosity is previously detected before the internal combustion engine is stopped. Namely, a characteristic of the viscosity is estimated during the previous operating period of the internal combustion engine. The estimation means estimates the viscosity of the hydraulic fluid FL based on the time-rate-of-change of the relative rotation angle at the time of relative rotation angle adjustment by the relative rotation angle adjustment mechanism J before the start of the internal combustion engine. When the viscosity is high, the time-rate-of-change of the relative rotation angle is low. Meanwhile, when the viscosity is low, the time-rate-of-change of the relative rotation angle is high. Accordingly, the viscosity is estimated based on the time-rate-of-change. Namely, the electronic control unit ECU obtains data which is the basis of estimation, in a mode in which relative rotation angle adjustment is performed. The data is obtained by the relative rotation angle detection sensor which detects the relative rotation angle. The sensor S is a relative rotation angle sensor.

Since the characteristic of the viscosity of the hydraulic fluid FL changes according to the temperature, the viscosity can be estimated based on the temperature. A method for detecting the temperature of the hydraulic fluid is as mentioned above.

The fact that the viscosity depends on the temperature signifies that the viscosity can be estimated based only on information regarding the temperature.

Figure 13:
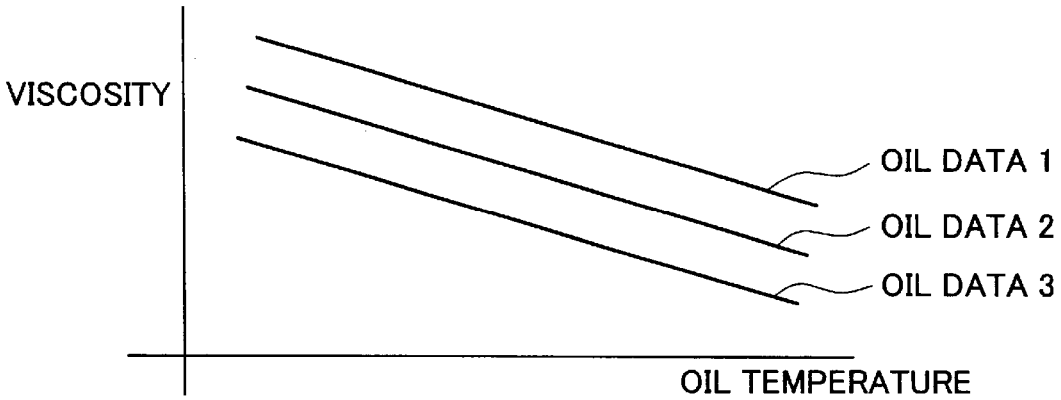
FIG. 13 is a graph showing a relation between an oil temperature and a viscosity when oil is used as the hydraulic fluid.

FIG. 13 is a graph showing a relation between the oil temperature and the viscosity when oil is used as the hydraulic fluid FL. As the temperature becomes higher, the viscosity becomes lower.

The estimation means performs a computation on the viscosity based on the temperature of the hydraulic fluid FL. When the temperature of the hydraulic fluid FL is high, the viscosity is low. Meanwhile, when the temperature of the hydraulic fluid FL is low, the viscosity is high. Accordingly, the viscosity is estimated based on the temperature of the hydraulic fluid FL. The method for detecting the temperature of the hydraulic fluid is as mentioned above. Detection of temperature using the estimated value will be briefly described.

The temperature which is used for estimating the viscosity need not be a directly detected value, and an estimated value can be used. Namely, the estimation means can estimate the temperature based on the stop period of the internal combustion engine before the start of the internal combustion engine. The temperature of the hydraulic fluid FL depends on the stop period of the internal combustion engine, as mentioned above.

The parameter which is used for estimating the temperature used for estimating the viscosity is as mentioned above. Namely, the operating period and the load of the internal combustion engine in addition to the stop period of the internal combustion engine can be used for estimating the temperature of the hydraulic fluid FL. The estimation means estimates the temperature of the hydraulic fluid FL based on the operating period and/or the load of the internal combustion engine after the start of the internal combustion engine in addition to the stop period of the internal combustion engine. The temperature of the hydraulic fluid FL depends on the operating period and/or the load of the internal combustion engine, as mentioned above.

Also, it is apparent that the viscosity depends on the original characteristic of the hydraulic fluid FL in addition to the temperature of the hydraulic fluid FL.

As can be understood from FIG. 13, the viscosity changes depending on a characteristic value (oil data) of the hydraulic fluid FL. Namely, the estimation means can also estimate the viscosity based on the characteristic value and the temperature of the hydraulic fluid FL. Since the characteristic value is determined depending on a type of the hydraulic fluid FL, the viscosity can be estimated based on the temperature and the characteristic value of the hydraulic fluid FL. The characteristic value may be input by a user.

The unlocking force (Q) also depends on the physical position of the hydraulic fluid FL in addition to the pressure, in terms of how promptly unlocking can be performed. Namely, when the moving distance which is necessary for the hydraulic fluid FL to be applied to the lock mechanism is long, the unlocking force (Q) is small. Meanwhile, when the moving distance which is necessary for the hydraulic fluid to be applied to the lock mechanism is short, the unlocking force (Q) is large. When the hydraulic fluid FL relatively moves away from the point (lock member PIN) at which the hydraulic fluid FL is applied to the lock mechanism according to the stop period of the internal combustion engine, the unlocking force (Q) can be obtained based on the stop period of the internal combustion engine. More specifically, when the stop period of the internal combustion engine is long, the period until the hydraulic fluid FL is effectively applied tends to be long. Accordingly, the unlocking force (Q) becomes smaller.

The computation means extends the time (T) when the relative rotation angle does not change after relative rotation angle adjustment is started by the relative rotation angle adjustment mechanism J. The fact that the relative rotational angle does not change signifies that unlocking by the lock mechanism L has not been completed. Accordingly the time of relative rotation angle adjustment is extended so as to protect the lock mechanism L.

The electronic control unit ECU further can determine that there is a failure, when the extended time (T) exceeds a predetermined value (TTH). The ECU determines that the relative rotation angle is locked at one or more portions in the case where the relative rotation angle does not change even when the time is extended to a certain extent.

The relation defined above is stored in a memory after being mapped, and is extracted at the time of computation so as to determine an unknown estimated value. When it is impossible to estimate both of the estimated values, the initial value is used.

Figure 14:
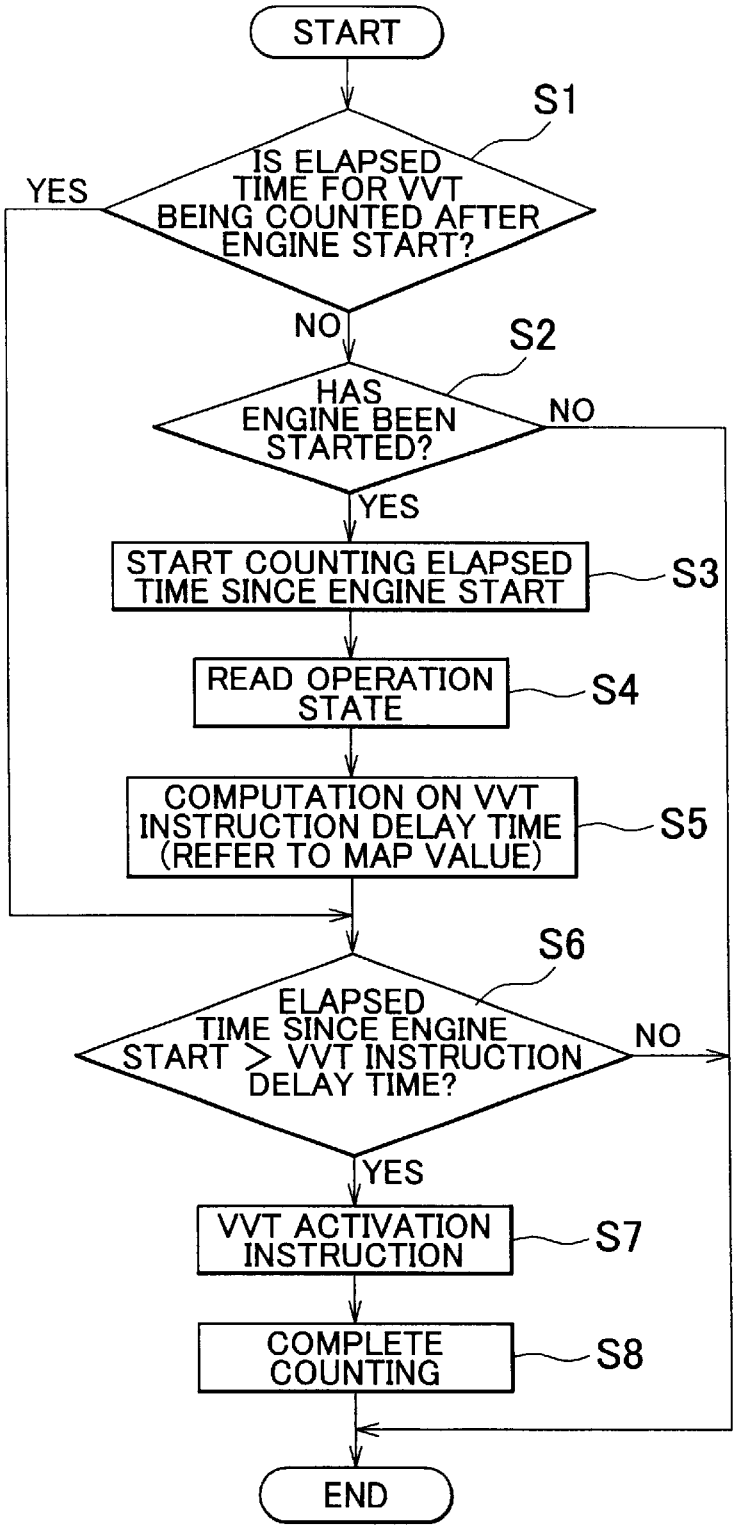
FIG. 14 is a flowchart for explaining control by an electronic control unit (ECU) implementing an embodiment of the invention.

FIG. 14 is a flowchart explaining control by the electronic control unit ECU. In this case, control in which a water temperature is used is described as an example.

First, it is determined whether time count for setting the delay time is being performed (S1). More specifically, it is determined whether the elapsed time for controlling VVT after the start of the internal combustion engine (engine) is being counted. When such a count has not been performed yet, it is determined whether the internal combustion engine has been started (S2).

Next, the elapsed time since the internal combustion engine is started is counted (S3). Then, the water temperature (operation state) is read from the sensor S so as to set the unlocking force (S4).

After that, in S5, a computation on the delay time (T) is performed based on the water temperature (unlocking force). In this case, the delay time (T) is extracted based on the corresponding water temperature on the assumption that the relation between the water temperature and the delay time is mapped.

Further, the elapsed time since the internal combustion engine is started and the computed delay time (T) are compared (S6). When the elapsed time exceeds the delay time (T), relative rotation angle adjustment is started (S7), and count of the elapsed time is completed (S8).

When the elapsed time count has already been started in step S1, determination in step S6 is performed. When the elapsed time exceeds the delay time (T), relative rotation angle adjustment is started (S7), and the elapsed time count is completed (S8).

In this control, it is possible to protect the lock mechanism L, and to perform transition to the VVT control promptly by performing a computation on the delay time based on the water temperature.

The above-mentioned control apparatus is effective on a power system in which intermittent operation of the internal combustion engine is performed, and is particularly effective on a hybrid vehicle.

According to the above-mentioned valve opening/closing timing control apparatus, efficiency and operating performance of the internal combustion engine can be enhanced.

The controller (e.g., the ECU) of the illustrated exemplary embodiments is implemented as a programmed general purpose computer. It will be appreciated by those skilled in the art that the controller can be implemented using a single special purpose integrated circuit (e.g., ASIC) having a main or central processor section for overall, system-level control, and separate sections dedicated to performing various different specific computations, functions and other processes under control of the central processor section. The controller can be a plurality of separate dedicated or programmable integrated or other electronic circuits or devices (e.g., hardwired electronic or logic circuits such as discrete element circuits, or programmable logic devices such as PLDs, PLAs, PALs or the like). The controller can be implemented using a suitably programmed general purpose computer, e.g., a microprocessor, microcontroller or other processor device (CPU or MPU), either alone or in conjunction with one or more peripheral (e.g., integrated circuit) data and signal processing devices. In general, any device or assembly of devices on which a finite state machine capable of implementing the procedures described herein can be used as the controller. A distributed processing architecture can be used for maximum data/signal processing capability and speed.

While the invention has been described with reference to exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. A valve opening/closing timing control apparatus, comprising:

a camshaft whose rotation is synchronized with opening/closing timing of an intake valve or an exhaust valve of an internal combustion engine;

a relative rotation angle adjustment mechanism which transmits torque of a crankshaft of the internal combustion engine to the camshaft, and which adjusts a relative rotation angle between the crankshaft and the camshaft;

a lock mechanism which utilizes hydraulic fluid, and which selectively mechanically locks and unlocks the relative rotation angle that is adjusted by the relative rotation angle adjustment mechanism; and a controller which determines a duration of a time period from a start of the internal combustion engine until a start of relative rotation angle adjustment by the relative rotation angle adjustment mechanism, based upon an unlocking force of the hydraulic fluid that is applied to the lock mechanism when the lock mechanism is in a locked state and the internal combustion engine is started.

2. The valve opening/closing timing control apparatus according to claim 1, wherein the unlocking force is obtained based on a pressure of the hydraulic fluid.

3. The valve opening/closing timing control apparatus according to claim 2, further comprising:

a hydraulic pressure detection sensor which detects the pressure of the hydraulic fluid.

4. The valve opening/closing timing control apparatus according to claim 2, wherein the controller estimates the pressure of the hydraulic fluid based on predetermined input information.

5. The valve opening/closing timing control apparatus according to claim 4, wherein the controller estimates the pressure of the hydraulic fluid using a temperature of the hydraulic fluid as the input information.

6. The valve opening/closing timing control apparatus according to claim 5, wherein the controller is linked to a temperature sensor which detects the temperature of the hydraulic fluid.

7. The valve opening/closing timing control apparatus according to claim 5, wherein the controller estimates the temperature of the hydraulic fluid based on a stop period of the internal combustion engine.

8. The valve opening/closing timing control apparatus according to claim 7, wherein the controller estimates the temperature of the hydraulic fluid based on at least one of an operating period and a load of the internal combustion engine after the start of the internal combustion engine in addition to the stop period.

9. The valve opening/closing timing control apparatus according to claim 8, wherein the controller corrects the estimated temperature of the hydraulic fluid based on a temperature of a cooling medium which cools the internal combustion engine.

10. The valve opening/closing timing control apparatus according to claim 5, wherein the controller estimates the temperature of the hydraulic fluid based on a temperature of a cooling medium which cools the internal combustion engine.

11. The valve opening/closing timing control apparatus according to claim 4, wherein the controller estimates the pressure of the hydraulic fluid using a stop period of the internal combustion engine before the start of the internal combustion engine as the input information.

12. The valve opening/closing timing control apparatus according to claim 4, wherein the controller estimates the pressure of the hydraulic fluid using at least one of an operating period and a load of the internal combustion engine as the input information.

13. The valve opening/closing timing control apparatus according to claim 4, wherein the controller estimates the pressure of the hydraulic fluid using a temperature of a cooling medium which cools the internal combustion engine as the input information.

14. The valve opening/closing timing control apparatus according to claim 2, wherein the controller estimates the unlocking force based on a viscosity of the hydraulic fluid in addition to the pressure of the hydraulic fluid.

15. The valve opening/closing timing control apparatus according to claim 14, wherein the controller estimates the viscosity based on a time-rate-of-change of the relative rotation angle when relative rotation angle adjustment is performed by the relative rotation angle adjustment mechanism before the start of the internal combustion engine.

16. The valve opening/closing timing control apparatus according to claim 14, wherein the controller estimates the viscosity based on a temperature of the hydraulic fluid.

17. The valve opening/closing timing control apparatus according to claim 16, wherein the controller estimates the temperature of the hydraulic fluid based on a stop period of the internal combustion engine before the start of the internal combustion engine.

18. The valve opening/closing timing control apparatus according to claim 17, wherein the controller estimates the temperature of the hydraulic fluid based on at least one of an operating period and a load of the internal combustion engine after the start of the internal combustion engine in addition to the stop period.

19. The valve opening/closing timing control apparatus according to claim 16, wherein the controller estimates the viscosity based on a characteristic value of the hydraulic fluid and the temperature of the hydraulic fluid.

20. The valve opening/closing timing control apparatus according to claim 1, wherein the hydraulic fluid relatively moves away from a point at which the hydraulic fluid is applied to the lock mechanism according to a stop period of the internal combustion engine, and the controller estimates the unlocking force based on the stop period of the internal combustion engine.

21. The valve opening/closing timing control apparatus according to claim 1, wherein the controller extends the duration of the time period until the start of the relative rotation angle adjustment by the relative rotation angle adjustment mechanism when the relative rotation angle does not change after the start of the relative rotation angle adjustment by the relative rotation angle adjustment mechanism.

22. The valve opening/closing timing control apparatus according to claim 21, wherein the controller determines that there is a failure when the extended duration of the time period exceeds a predetermined value.

23. The valve opening/closing timing control apparatus according to claim 1, wherein the unlocking force is obtained based on a temperature of a cooling medium which cools the internal combustion engine.

24. The valve opening/closing timing control apparatus according to claim 1, wherein the unlocking force is obtained based on a temperature of the hydraulic fluid.

25. The valve opening/closing timing control apparatus according to claim 1, wherein the unlocking force is obtained based on a stop period of the internal combustion engine.

26. A method of controlling a valve opening/closing timing of a system that includes: a camshaft whose rotation is synchronized with opening/closing timing of an intake valve or an exhaust valve of an internal combustion engine; a relative rotation angle adjustment mechanism which transmits torque of a crankshaft of the internal combustion engine to the camshaft, and which adjusts a relative rotation angle between the crankshaft and the camshaft; and a lock mechanism which utilizes hydraulic fluid, and which selectively mechanically locks and unlocks the relative rotation angle that is adjusted by the relative rotation angle adjustment mechanism; the method comprising:

determining a duration of a time period from a start of the internal combustion engine until a start of relative rotation angle adjustment by the relative rotation angle adjustment mechanism, based upon an unlocking force of the hydraulic fluid that is applied to the lock mechanism when the lock mechanism is in a locked state and the internal combustion engine is started.

27. The method according to claim 26, further comprising obtaining the unlocking force based on a pressure of the hydraulic fluid.

28. The method according to claim 27, wherein the pressure of the hydraulic fluid is obtained by a hydraulic pressure detection sensor.

29. The method according to claim 27, wherein the pressure of the hydraulic fluid is estimated based on predetermined input information.

30. The method according to claim 29, wherein the pressure of the hydraulic fluid is estimated using a temperature of the hydraulic fluid as the input information.

31. The method according to claim 30, wherein the temperature of the hydraulic fluid is detected by a temperature sensor which detects the temperature of the hydraulic fluid.

32. The method according to claim 30, wherein the temperature of the hydraulic fluid is estimated based on a stop period of the internal combustion engine.

33. The method according to claim 32, wherein the temperature of the hydraulic fluid is estimated based on at least one of an operating period and a load of the internal combustion engine after the start of the internal combustion engine in addition to the stop period.

34. The method according to claim 33, wherein the estimated temperature of the hydraulic fluid is corrected based on a temperature of a cooling medium which cools the internal combustion engine.

35. The method according to claim 30, wherein the temperature of the hydraulic fluid is estimated based on a temperature of a cooling medium which cools the internal combustion engine.

36. The method according to claim 29, wherein the pressure of the hydraulic fluid is estimated using a stop period of the internal combustion engine before the start of the internal combustion engine as the input information.

37. The method according to claim 29, wherein the pressure of the hydraulic fluid is estimated using at least one of an operating period and a load of the internal combustion engine as the input information.

38. The method according to claim 29, wherein the pressure of the hydraulic fluid is estimated using a temperature of a cooling medium which cools the internal combustion engine as the input information.

39. The method according to claim 27, wherein the unlocking force is estimated based on a viscosity of the hydraulic fluid in addition to the pressure of the hydraulic fluid.

40. The method according to claim 39, wherein the viscosity is estimated based on a time-rate-of-change of the relative rotation angle when relative rotation angle adjustment is performed by the relative rotation angle adjustment mechanism before the start of the internal combustion engine.

41. The method according to claim 39, wherein the viscosity is estimated based on a temperature of the hydraulic fluid.

42. The method according to claim 41, wherein the temperature of the hydraulic fluid is estimated based on a stop period of the internal combustion engine before the start of the internal combustion engine.

43. The method according to claim 42, wherein the temperature of the hydraulic fluid is estimated based on at least one of an operating period and a load of the internal combustion engine after the start of the internal combustion engine in addition to the stop period.

44. The method according to claim 41, wherein the viscosity is estimated based on a characteristic value of the hydraulic fluid and the temperature of the hydraulic fluid.

45. The method according to claim 26, wherein the hydraulic fluid relatively moves away from a point at which the hydraulic fluid is applied to the lock mechanism according to a stop period of the internal combustion engine, and the unlocking force is estimated based on the stop period of the internal combustion engine.

46. The method according to claim 26, wherein the duration of the time period until the start of the relative rotation angle adjustment by the relative rotation angle adjustment mechanism is extended when the relative rotation angle does not change after the start of the relative rotation angle adjustment by the relative rotation angle adjustment mechanism.

47. The method according to claim 46, further comprising determining that there is a failure when the extended duration of the time period exceeds a predetermined value.

48. The method according to claim 26, wherein the unlocking force is obtained based on a temperature of a cooling medium which cools the internal combustion engine.

49. The method according to claim 26, wherein the unlocking force is obtained based on a temperature of the hydraulic fluid.

50. The method according to claim 26, wherein the unlocking force is obtained based on a stop period of the internal combustion engine.

* * * * *